United States Patent [19]

Swager

[11] 4,269,284

[45] May 26, 1981

[54] SLIDING CLAMP AND ADAPTOR

[76] Inventor: William E. Swager, P.O. Box 498, Fremont, Ind. 46737

[21] Appl. No.: 945,792

[22] Filed: Sep. 25, 1978

[51] Int. Cl.[3] ..... E06C 7/18; A62B 1/16

[52] U.S. Cl. ..... 182/8

[58] Field of Search ..... 182/8, 133–136; 308/3 R, 5 R, 239, 238; 16/87.6 R, 87.8

[56] References Cited

U.S. PATENT DOCUMENTS

| | | | |
|---|---|---|---|
| 1,941,768 | 1/1934 | Vigne | 308/239 |
| 3,348,632 | 10/1967 | Swager | 182/230 |
| 4,072,372 | 2/1978 | Korrenn | 308/239 |
| 4,085,818 | 4/1978 | Swager | 182/8 |

FOREIGN PATENT DOCUMENTS

| | | | |
|---|---|---|---|
| 593107 | 5/1959 | Italy | 182/8 |

*Primary Examiner*—Reinaldo P. Machado

[57] ABSTRACT

A sliding clamp is provided for slideable mounting upon variously sized rails and has an adaptor disposed between the clamp housing and rail surface for accommodating the clamp to variously smaller sized rails for support and easy sliding fit upon such rails. The adaptor may be of plastic and particularly at least its inner surface in contact with the rail may be formed of a lubricating plastic substance for substantially friction free sliding movement thereon.

14 Claims, 11 Drawing Figures

Fig. 7
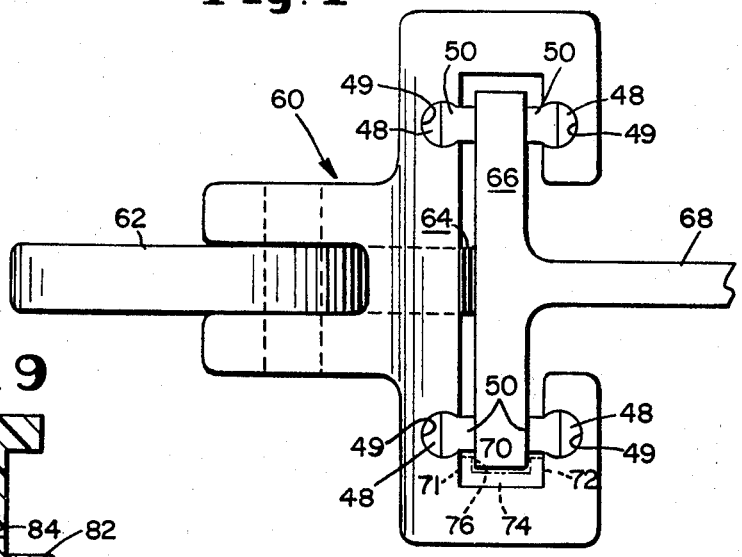
Fig. 10
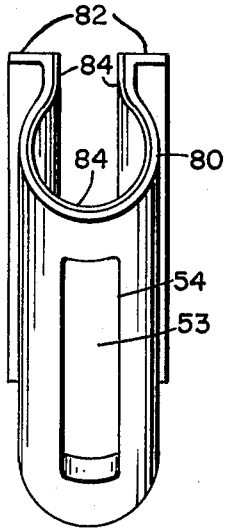
Fig. 9
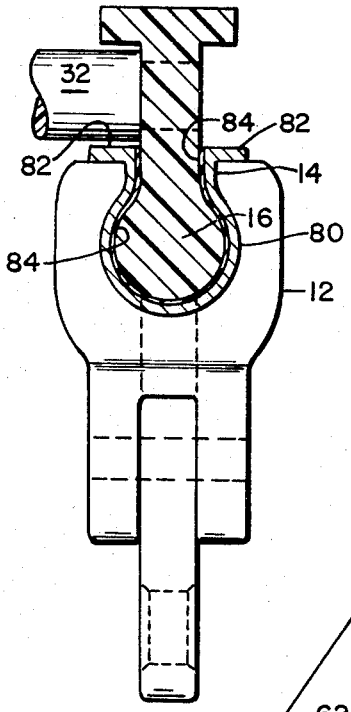
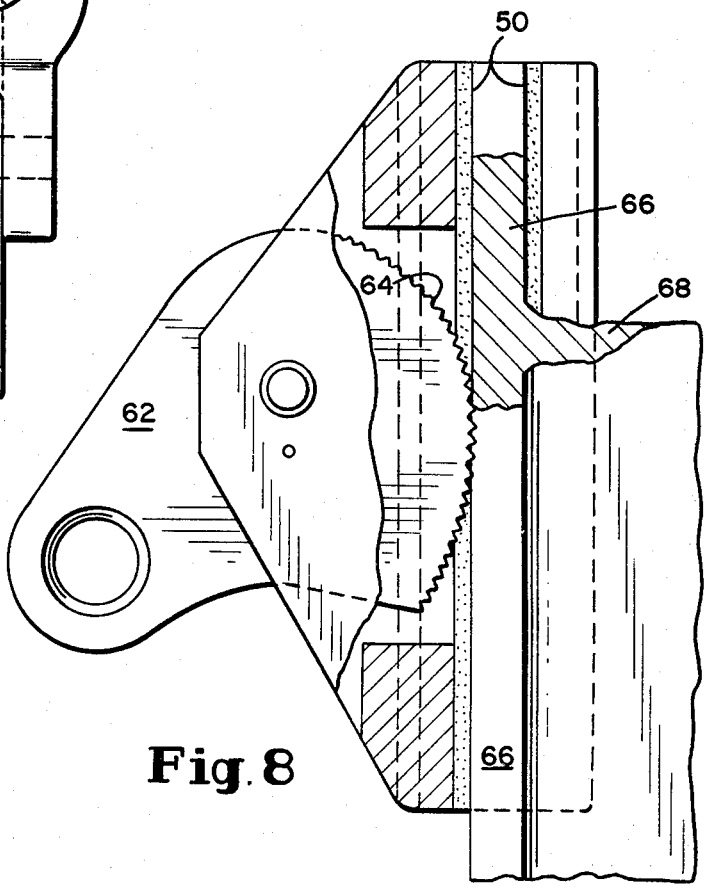
Fig. 8
Fig. 11
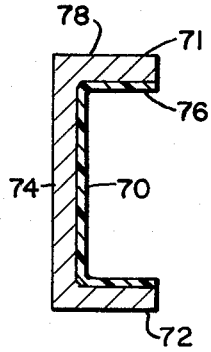

SLIDING CLAMP AND ADAPTOR

This invention relates to a slide and grip type of safety clamp combined with an adaptor for mounting the clamp to slidably fit upon a rail, upon which it will alternately slide and clamp, for use by a climber as a safety device for climbing and descending of a stairway or ladder having a side rail, the adaptor being sized to allow the clamp universally to be mountable upon rails of various other sizes.

The invention is an improvement upon slidable clamps, for instance as shown in my prior clamp U.S. Pat. Nos. 3,348,632; 3,933,320; 4,085,818; 4,068,960; 4,059,871, and as well as other slidable clamp patents such as U.S. Pat. No. 2,616,609, in that the combined ladder and clamp hereof further includes an adaptor supporting, spacing and imparting lubrication to the clamp upon the ladder rail, adapted to fit with easy sliding movement thereon, as well as clamping upon the rail in the event of mis-step of the climber, who carries the clamp attached by a rope or chain to his belt as a safety device in ascending or descending the ladder or stairway.

The clamps are mountable upon the rails in sliding fit thereon, and as shown in my U.S. Pat. No. 4,085,818, has been supported by non-friction rollers to impart such sliding movement, the rollers and clamp being sized to impart exact sliding fit about the surface of the particular rail being used. However, that rail attached to a ladder is a relatively permanent part thereof and it usually is sized for permanent use with this ladder. Even for use of a staircase rail, it may have been designed for use with a particular clamp, and variously sized clamps serving the same purpose but of larger dimension, may be so large and loose that it will not slide nor will the clamping means reliably grip upon an undersized rail designed for some other, more exactly dimensioned rail.

According to the present invention an adaptor is mounted between the clamp housing and the rail, in substitution for rollers, such as shown in my companion U.S. Pat. No. 4085818, to correct the internal dimension of the clamp for mounting against a smaller rail variously sized. In the clamp construction of said application the rollers will be removed and the adaptor will be in the form of strips, generally plastic strips sized to correct the internal dimension of the clamp, as needed for use with an undersized rail. Hence the adaptor in the form of strips are substituted for the rollers. Such strips are supported within the roller grooves and are sized to accommodate the dimensional differences between the clamp housing and the rail, so that, supported within the grooves, the strips extend inward toward the rail surface about which the clamp is mounted. Thus, the clamp and adaptor slidingly bears thereagainst and fills the spacing distance between the rail surface and the clamp as a dimensional adaptor to impart a supporting, sliding fit between the clamp housing and the rail surface for sliding fit thereabout. At least the inner adaptor surface may supply a lubricating function to enhance the sliding movement of the clamp upon the rail surface, and for this purpose the coating or entire body substance of the adaptor may be TEFLON, commercially available under this trademark, comprising polytetrafloroethylene, a plastic known to have such lubricating property.

In other modifications, the adaptor will be variously shaped to allow sliding motion between the clamp and rail surface to be gripped thereby, and will be sized to fill the spacing between the clamp body and rail surface with clamp sliding clearance therebetween. Thus, the adaptor may be shaped as strips, it may be molded into linearly extending shapes, such as angle or channel shapes formed of TEFLON or TEFLON coated plastic, or it may be an annularly shaped sleeve member mountable between the clamp body and rail surface.

The invention is further described with reference to the drawings which show several clamp constructions, as well as TEFLON shapes as exemplary and not limiting of the invention, wherein:

FIG. 1 shows a clamp such as shown in my U.S. Pat. No. 4,085,818 mounted on the hand rail of a step ladder;

FIG. 2 is a section taken on the line 2—2 of FIG. 1, showing the clamp and intermediate adaptor strips in plan view;

FIG. 3 is an elevational view of the clamp of FIGS. 1 and 2 looking in the direction of the arrows 3 of FIGS. 1 and 2 as the clamp appears removed from the rail;

Figure 5:
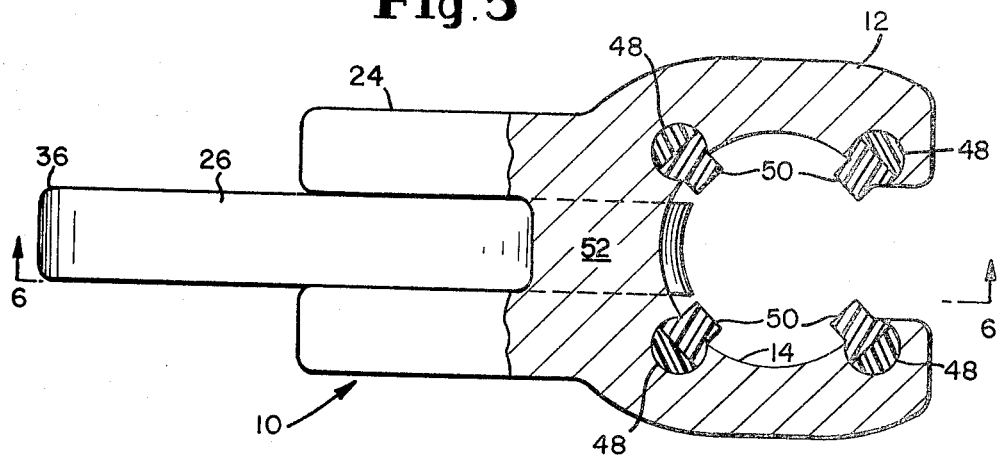
FIG. 5 is a plan view of the clamp in section taken on the lines 5—5 of FIG. 4.

FIG. 7 is a clamp of the type shown in my U.S. Pat. No. 3,348,632 with plastic adaptor strips substituting for rollers therein;

FIG. 8 is a side elevation of the clamp of FIG. 7 with parts broken away and in section;

FIG. 9 is a plan view in section similar to FIG. 5 having a sleeve type adaptor substituting for the adaptor strips of FIG. 5;

FIG. 10 shows an annular sleeve adaptor of FIG. 9 having an elongated slot therein; and FIG. 11 is a detail showing the adaptor shaped as a channel and substitutable for a pair of adaptor strips of FIG. 7 at each end, as shown in dotted line therein, as a channel-type adaptor.

Figure 1:
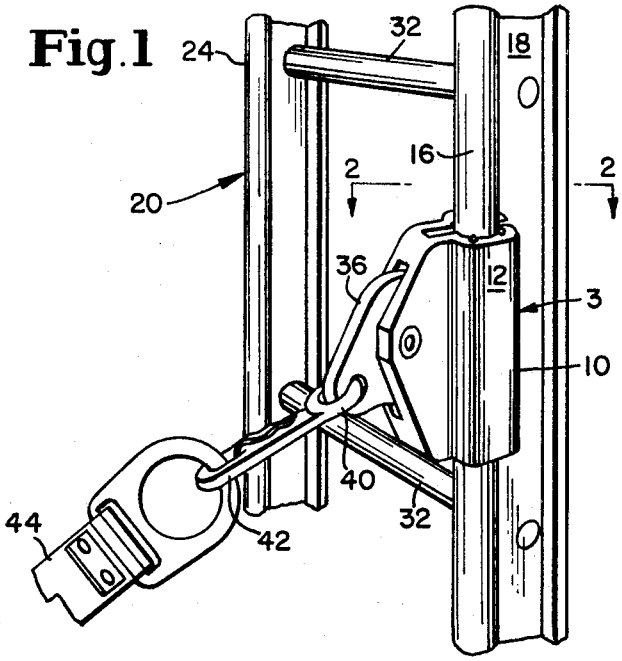
Figure 2:
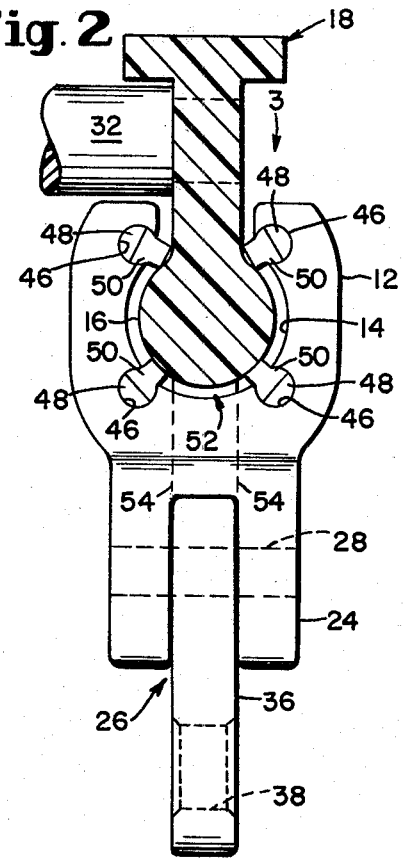
Figure 3:
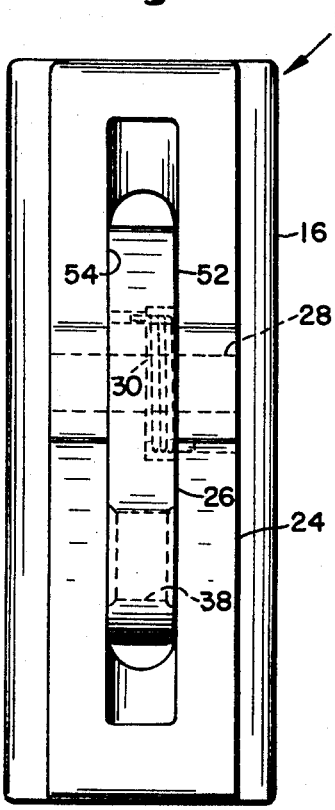
Figure 4:
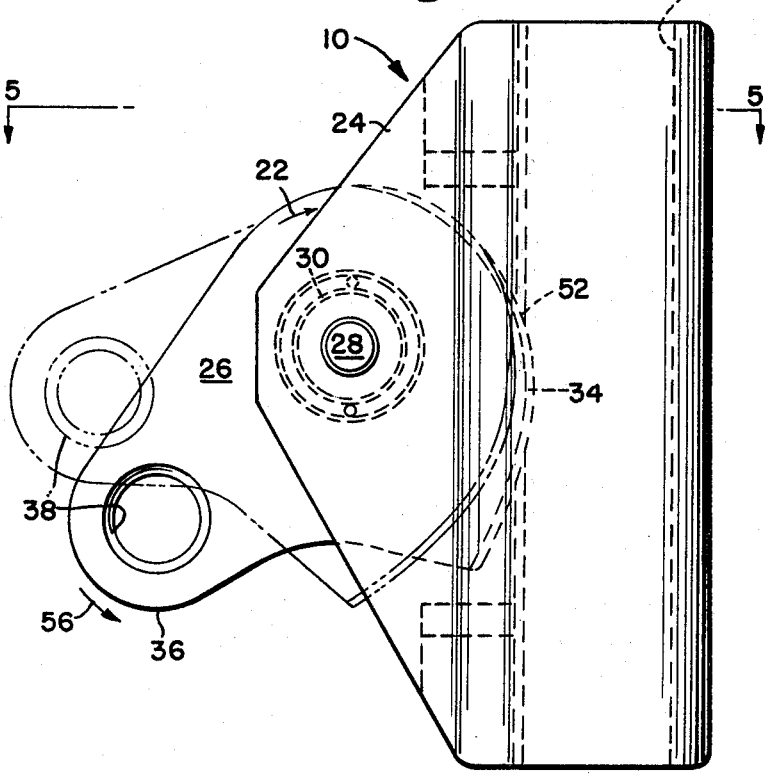
FIG. 4 is a side elevation of the clamp illustrating its gripping function in clamping and unclamped (full line) positions.

FIGS. 1–7 show a clamp 10 of the type that is discussed in detail in my companion U.S. Pat. No. 4,085,818, having a housing 12 shaped with an inner annular cut-away portion 14 to encase and mount about a circular rail portion 16 of a rail 18 of a ladder 20. The rail 18 is typically disposed as a right hand side of a ladder 20 connected by rungs 32 to a companion side rail 24 of a step ladder 20. Both rails 18 and 24 may be similarly shaped to provide an annular end 16 for grasping by hand, or may form only one side thereof. As shown in FIG. 1, one side is annularly shaped, such as circular at 16, at least to have slidingly mounted thereon the clamping member 10 for easy slidable movement upon the annular rail 16. The housing 12 has a pair of notched ears 24 through which is pivotally mounted a clamping cam element 26, supported for pivotal movement upon a pivot 28. The cam 26 is biased by a spring 30 about the pivot 28, which biases the cam in the direction of the arrow 22 into clamping engagement with the annular surface of the rail 16, as shown in dotted line position 34 of FIG. 4. The outer portion 36 of the cam 26 extends outwardly of the clamp as a trigger arm as shown in FIG. 1 and is engaged through an eye 38 by a link 40 of a chain or rope 42, which fastens to a belt 44 of a climber, fastened around his middle for safety, as he ascends or decends the ladder 20. In either ascending or decending movement, the belt 44 generally draws the cam 26 of the clamp into disengaged full-line position of FIG. 4 against the bias of spring 30, whereby the cam is freed from the rail surface 16 for easy sliding movement of the clamp thereon, both with ascending and decending motion of the climber merely by the pull of the climbers belt against the weight of the clamp fastened thereto by chain 42. If he mis-steps or suddenly releases the pull upon the linkage 42, the clamp 10, either by bias of spring 30, or by downward pull of the chain 42 on the trigger arm 36 causes the cam surface to engage the rail surface 16 and clamp firmly thereagainst, preventing further movement of the clamp and climber fastened thereto upon the rail 16.

As shown in my prior patent the clamp engages the annular surface 16 through several rollers rotatably supported in grooves 46 disposed about the inner wall 14 of the clamp 4 sliding separate thereof of the surface 16.

According to the present invention, and for purposes of allowing the clamp to be used on variously smaller dimentioned rails, the rollers are replaced by plastic strips 48 disposed and fixed therein as shown within the grooves 46, the plastic strips extending radially inward and having a section 50 which engages the rail surface 16, each strip at a different circumferentially disposed position, thus to evenly bear in extended position of the section 5 against a position on the rail surface 16, for spacing and support of the clamp for firm sliding or clamping engagement against the smaller dimentioned rail surface 16. If the rail surface is of larger diameter the extending portions 50 of the strips will be smaller, enough to accommodate the distance from the inner strip portion to the rail surface as a spacing adaptor. Alternately, if the diameter of the rail were smaller, the extending portions would extend further, enough to engage and correspondingly space the rail surface 16 from the clamp. Generally these strips are each of the same dimension so that the clamp will be disposed in a centered position about the rail surface.

Consequently, the same clamp formed without rollers or with rollers removed, and with insertion of adaptor strips 48, having extended portions 50, selected for a size to fit the rail with which the clamp is to be used, will operate as an adaptor, each sized as needed for the rail dimension upon which the clamp will be used.

Since the clamp 10 still operates slidingly upon the rail, it is desired to impart an available lubricating function to the separating strip 48, and for this purpose the outer portion 50, at least the rail engaging the surface thereon, will be formed or coated with the lubricating plastic TEFLON. In this manner the strips centrally support the clamp, not only to give sliding clearance about the rail, but to space the clamp about the rail even for rail dimensions of varied sizes, so that only minor change is needed to supply the selected size of adaptor strip in the proper spacing dimension of the clamp with respect to the rail.

Moreover, at least the surface of the spacing strips will have a lubricating function for imparting easy sliding movement against the surface of the rail. The cam 26 mounted for rotation upon the pivot 28 will penetrate through a slot 52, bonded by walls 54 in spring biased dotted line position of FIG. 4, the surface of the cam 34 extending through the slot 52 will bear against the rail surface 16 in climbing motion of the user, with his belt drawing the trigger arm 36 through a chain 42, or bearing the weight of the clamp only in downward movement will hold the cam surface 34 of the clamp disengaged from the surface of the rail 16 in both ascending and descending movement. In downward pull of the chain 12 the trigger arm 36 will be drawn down in the direction of the arrow 56 and will cause the cam surface 34 to engage the rail 16 firmly clamping thereto in the dotted line position.

Moreover, it will be noted that this type of clamp may be formed by extrusion of the housing from any extrudable metal or plastic, the housing and grooves being formed therein by extrusion and easily assembled with extruded strips 48 fitted and supported therein, thus locked against radial movement. Other features of the clamp, such as addition of the cam, pivot and spring mounting being formed therewith with minor and economical machining to provide the clamp in operative form.

Figure 6:
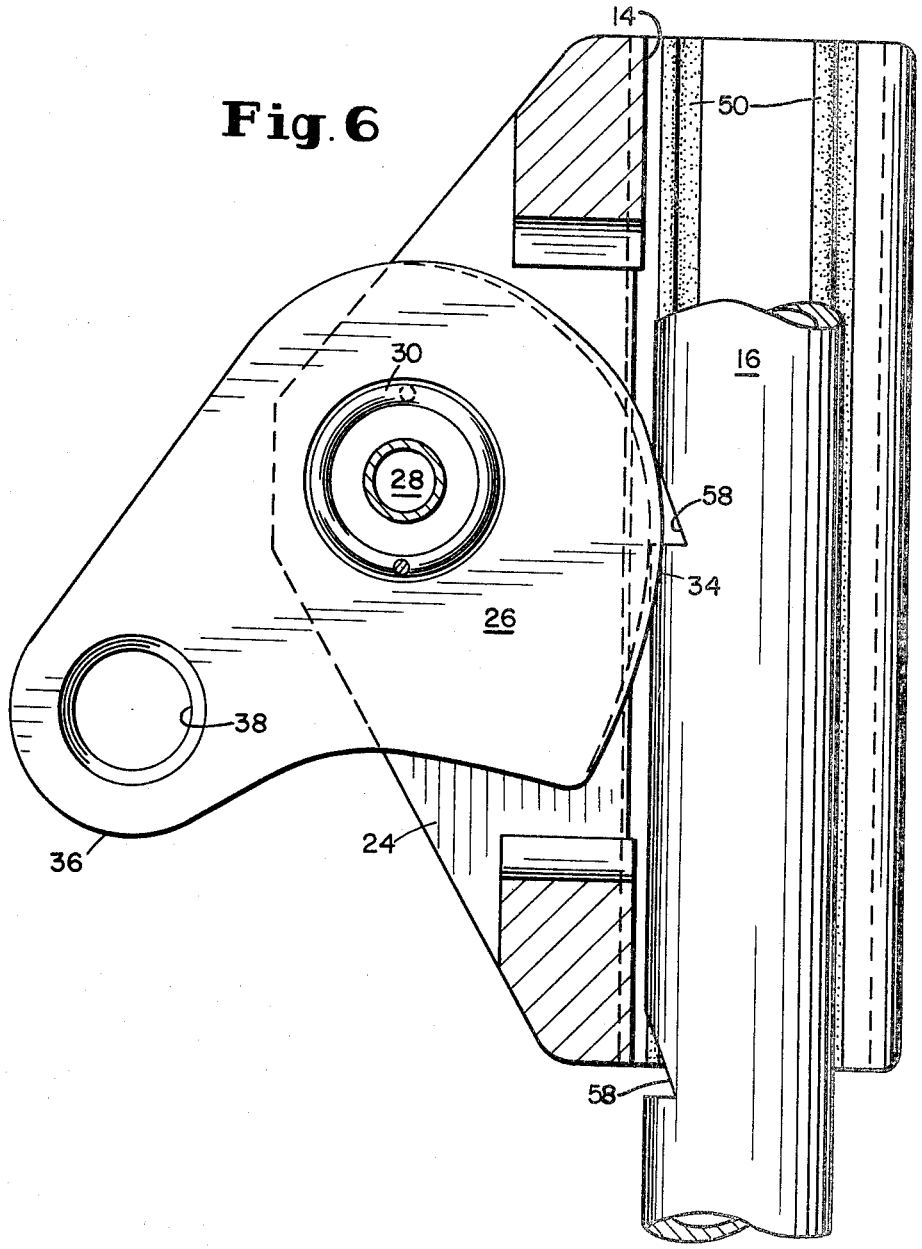
FIG. 6 is an elevational view of the clamp taken in section on the lines 6—6 of FIG. 5.

As shown in FIG. 6 a common type of small commercial rail bears notches 58 intended to be engaged by the type of clamp which bears a notch gripping portion extending for this purpose for engagement, as shown in U.S. Pat. No. 2,612,609. The clamp here described may not carry that kind of projection for engagement of a rail notch, but will usually be the smooth type of cam for clamping as described. However, the rail may be so notched as shown in that patent, but the clamp and adaptor hereof will nevertheless operate with such notched rail, as shown in FIG. 6, even at slightly different dimensions using the present adaptor.

As shown in FIG. 7, a clamp 60 is shown having a cam body 62 similarly supported as described above, but whose cam surface 64 has serrations which will bite into and clampingly engage a metal surface 66, such as the upper flange surface of an I-beam 68. That type of clamp is shown in greater detail in U.S. Pat. No. 3,348,632. As shown in that patent the clamp has rollers at each flange surface intended to engage both surfaces above and below the I-beam flange 66, and thus allow the beam 68 to be slidingly engaged by the clamp.

According to the present invention, the rollers are removed from grooves 49 and instead several plastic strips having a plastic body 48 and extending tip 50 are supported at their lower rounded ends within the grooves 49 to bear on both sides of the flange against the upper and lower surfaces thereof, for spacing and sliding support of the clamp above and below the surfaces thereof, for sliding movement thereon and gripping of the center of flange 66 by the serrated cam 62.

Again, as described above, the extending portion 50 of the strips or the entire strip may be formed of TEFLON for lubrication as well as support and spacing of the clamp upon the flange of the I-beam for easy sliding movement thereon.

As shown in FIG. 11, the pair of strips above and below the flange 66 of the I-beam 68 may be combined into a single channel-shaped strip 70, which will replace the upper and lower pairs of spacing strips of FIG. 7, the entire channel providing both the upper and lower spacing strips 71 and 72, bonded together intergrally as a channel by a back strip 74. Such channel is mounted in the position shown at the lower end position of FIG. 7 in dotted line position thereon, the alternate construction thereby being a single channel shaped strip to replace the pair of strips 48–50 engaging opposite flange surfaces and serving the purpose of the pair of strips 48 and 50, held together by the backing strip 74 as a channel. Again, the channel may have an inner coating of TEFLON disposed upon an outer plastic body of another plastic substance 78, such as polystyrene reinforced with glass fiber. Any other strong solid plastic suitably dimensioned for this purpose will be useful for channel type adaptor.

As shown in FIG. 9, the strips 48 and 50 as used in FIG. 2-6, are replaced by an inner annular sleeve 80 sized to fit within the housing 12, against the annular walls 14 as the larger sleeve dimension, and sized to have its inner side lie adjacent to the annular rail surface 16, whereby a complete sleeve is provided between the clamp housing and the rail surface. It may be useful to have outer flanges 82 for fitting against the inner housing surface 83. It also may have an inner coating 84 of TEFLON to impart lubrication for easy sliding movement between the clamp sleeve and surface 16.

As shown in FIG. 10, a portion of the sleeve 80 may have an elongated slot 53 cut into an annular area of the sleeve to accommodate the passage of the cam body therethrough for clamping engagement with the rail surface 16. That sleeve, as with the strips 48, 50, channels 70 etc., is of useful structure and dimension to provide an adaptor between a clamp and rail of several types, and any will be used in any of the several clamp constructions hereof to provide requisite spacing and support of the clamp in movement upon the rail. In preferred construction it also will provide lubrication, at least in its surface contact between the adaptor surface and the rail for easy sliding movement thereon.

As thus described the adaptor hereof allows the combination of variously sliding clamps to slidingly fit upon smaller variously sized rails for sliding movement thereon, to allow the clamping means to engage the rail, while providing requisite spacing for the movable clamp and the rail for smooth sliding engagement thereagainst.

The rail 16, too, can be variously shaped, that is, instead of circular it can be ovate or polygonal, and at least the inner portion of the sleeve, the strips or channels, will be so shaped and dimensioned as to provide requisite spacing between the rail surface of the clamp for original sliding, spacing and clamping engagement thereof. The rail may also be notched for use with another type of clamp, such as one having a detent intended to engage and secure the clamp into a notch, as shown in U.S. Pat. No. 2,616,609, the present adaptor allowing such clamp or any of those shown in my prior patents to be used with a notched rail, whereby any usual size of rail, or even one having notches may be used with other clamps, including an adaptor which adapts the clamp and rail into a good sliding fit.

Certain modifications will occur to those skilled in the art, the clamping means as well as means for mounting to the rail can be varied according to known structures.

In each case, however, the clamp and rail will be provided, according to this invention with an adaptor means, which will allow easy sliding fit and movement, as well as correct spacing for clamping engagement therebetween.

I claim:

1. A clamp having a rail clamping means and a housing portion shaped for mounting about and sliding longitudinally upon the surface of a supporting rail, an elongated supporting rail surface portion for disposal within said housing surface portion of said clamp for sliding support thereof and for clamping engagement by said clamping means, and an adaptor element mounted replaceably fixed in said housing and against lateral movement between said inner housing surface of said clamp and said rail surface sized for spacing and support of said clamp for easy sliding movement of said clamp on said rail support, said rail clamping means movable into engagement with said rail surface through an open portion of said adaptor and operative by a movement of an arm extending outward of said clamp for clampingly engaging said rail surface.

2. The clamp and rail as defined in claim 1, wherein the adaptor element has an open portion through which the clamping element passes for engagement of said rail.

3. The clamp and rail as defined in claim 1, wherein said adaptor is formed of plastic sized and fixed in said clamp housing for spacing and supporting said clamp housing upon said rail for easy sliding movement of said clamp thereon.

4. The clamp and rail as defined in claim 3, wherein said adaptor is formed of a rigid plastic body substance having at least its surface adjacent to said rail formed of lubricating substance for support and easy sliding movement of said clamp on said rail.

5. The clamp and rail as defined in claim 4, wherein the lubricating substance comprising at least the surface of said plastic is polytetrafloro ethylene.

6. The clamp and rail as defined in claim 1, wherein the adaptor element is a plurality of circumferentially spaced strips extending longitudinally of the portion of said housing, and said clamping element engages the rail in a space between said strips.

7. The clamp as defined in claim 6, wherein said adaptor is formed of plastic strips having at least their surface portions adjacent to the rail surface formed of a lubricating substance for lubricating the easy sliding support and movement of said clamp on said rail.

8. The clamp and rail as defined in claim 1, wherein said adaptor is an annular sleeve sized for positioning in said annular housing, with one surface bearing against said clamp housing surface and an opposite surface bearing against a surface of said rail, said adaptor being sized for support and spacing of said housing for easy sliding movement of said clamp upon said rail, said adaptor sleeve having a cut-away portion to receive and operate said clamping means for direct clamping engagement of said clamping means with said rail surface.

9. The clamp and rail as defined in claim 8 wherein at least the surface of said annular sleeve adaptor adjacent to said rail is formed of a lubricating substance for lubricating and providing easy sliding support of said clamp on said rail.

10. The clamp and rail as defined in claim 1, wherein said rail surface is a flat flange-like body engaged by said clamp by sliding movement thereon and said adaptor is a pair of channel shaped strips having edges mounted both above and below the edges of said flange-like body fixed into and supported by the surrounding walls of said clamp housing for sliding support and spacing of said clamp upon said flange-like body at each opposite flange surface thereof.

11. The clamp and rail as defined in claim 10, wherein upper and lower flange surfaces of said rail are engaged by a channel-shaped strip of rigid plastic substance supported at each opposite rail edge by the inner surface of said clamp housing, for spacing and easy sliding support of said clamp to opposite edges of said flange.

12. The clamp and rail as defined in claim 11, wherein said channel strip has at least its rail engaging surface formed of polytetrafloro ethylene for lubricating and providing easy sliding support of said clamp upon said rail.

13. The clamp and rail as defined in claim 10, wherein upper and lower flange surfaces of said rail are engaged by adaptor strips supported in the housing of said clamp above and below the edges of said flange-like body comprising said rail, providing sliding support and spacing of said clamp at each opposite flange surface thereof.

14. The clamp and rail as defined in claim 13, wherein each strip has at least its rail engaging surface formed of polytetrafloroethylene for lubricating and providing easy sliding support on said rail.

* * * * *